US005477911A

United States Patent [19]

Ginzburg

[11] Patent Number: 5,477,911

[45] Date of Patent: Dec. 26, 1995

[54] TWIN ROLLER CASTER

[75] Inventor: Vladimir B. Ginzburg, Pittsburgh, Pa.

[73] Assignees: Danieli United, Inc.; International Rolling Mill Consultants, Inc., both of Pittsburgh, Pa.

[21] Appl. No.: 217,426

[22] Filed: Mar. 24, 1994

[51] Int. Cl.[6] ..... B22D 11/06; B22D 11/00

[52] U.S. Cl. ..... 164/480; 164/428

[58] Field of Search ..... 164/480, 428, 164/442, 448

[56] References Cited

U.S. PATENT DOCUMENTS

| | | | |
|---|---|---|---|
| 2,008,626 | 7/1935 | Murakami . | |
| 2,450,428 | 10/1948 | Hazelett . | |
| 3,794,106 | 2/1974 | Barsukov et al. . | |
| 4,546,814 | 10/1985 | Shibuya et al. | 164/428 |
| 4,703,791 | 11/1987 | Sakaguchi et al. | 164/428 |
| 4,955,428 | 9/1990 | Schrewe . | |
| 4,979,556 | 12/1990 | Braun et al. | 164/428 |
| 5,010,947 | 4/1991 | Yukumoto et al. . | |
| 5,052,471 | 10/1991 | Ueda et al. | 164/480 |
| 5,228,497 | 7/1993 | Romanowski | 164/428 |

FOREIGN PATENT DOCUMENTS

| | | | |
|---|---|---|---|
| 59-50958 | 3/1984 | Japan | 164/480 |
| 62-252643 | 11/1987 | Japan | 164/428 |
| 1-127148 | 5/1989 | Japan | 164/428 |

*Primary Examiner*—P. Austin Bradley
*Assistant Examiner*—I.-H. Lin
*Attorney, Agent, or Firm*—Armstrong, Westerman, Hattori, McLeland & Naughton

[57] ABSTRACT

Method and apparatus for casting metal strip in a twin roll caster wherein each of the rolls is provided with a surface of convex or concave configuratiion in at least a middle portion of the roll surface. Such surface may be formed mechanically on the roll or the roll may be bent into such configuration by applying bending force to the roll neck, or the roll may be cooled in a pattern forming a thermal crown of such configuration.

3 Claims, 8 Drawing Sheets

SECTION A - A

TWIN ROLLER CASTER

BACKGROUND

1. Field of the Invention

This invention relates to roller casters and method of roller casting and, more particularly, to casting appartus and methods in which liquid metal to be cast is introduced into the nip of rotating casting rolls which have at least a partial convex or concave configuration.

2. Description of Related Art

It is known to cast metal strip by feeding liquid metal into the nip formed by a pair of juxtaposed, oppositely rotating cylindrical rolls. However, a recurrent problem with such casting is the formation of cracks at the edges of the cast strip.

It is known, for example, from USSR author's certificate number 143,215 (1961), that, during casting of liquid metal in an open top, open bottom, stationary cooled mold having a width substantially greater than the thickness of the mold, to construct the wide side walls of the mold so that such walls, in at least a part thereof, have a convex or concave configuration, changing to a rectangular configuration (see FIGS. 1 and 2 of this present application). Such wall configuration is said to have the effect of decreasing the formation of cracks at the edges of the casting during solidification of the liquid metal.

SUMMARY OF THE INVENTION

This invention provides a twin roller caster for the casting of a wide, thin metal casting in which the opposed, rotating rolls have a surface which is, at least in part, at the middle of the nip between the rolls, of a convex or concave configuration so as to inhibit the formation of cracks near the edges of the casting.

DESCRIPTION OF PREFERRED EMBODIMENTS

Figure 1:
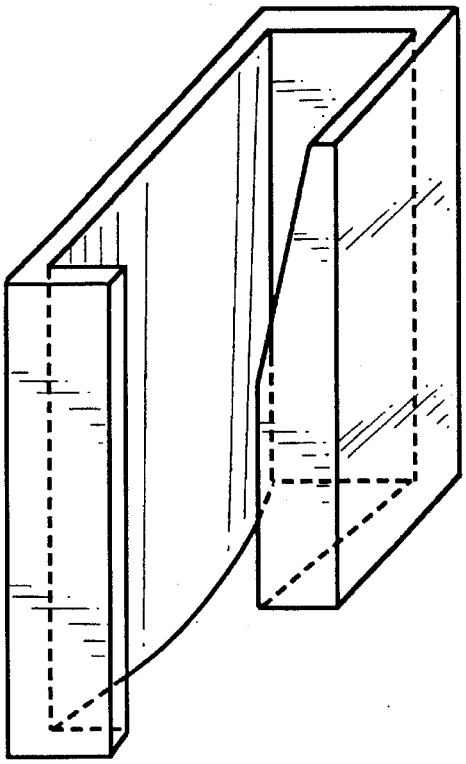
PRIOR ART FIG. 1
FIGS. 1 and 2 are isometric views of two different forms of prior art open top, open bottom statiionary casting molds utilizing at least partial curvature of the wide mold walls.
Figure 2:
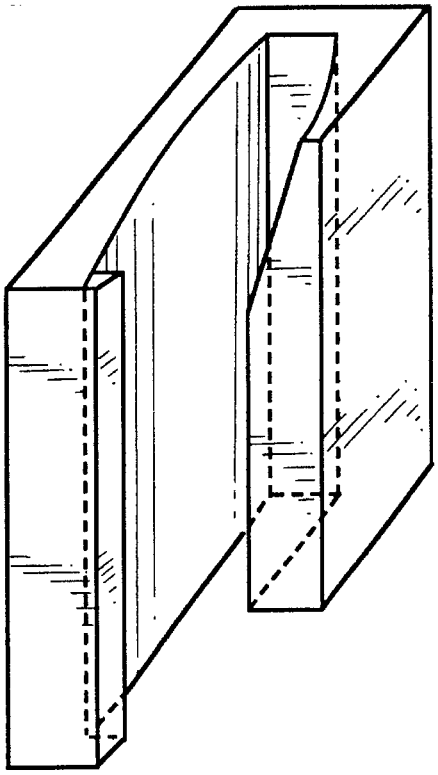
PRIOR ART FIG. 2
Figure 3:
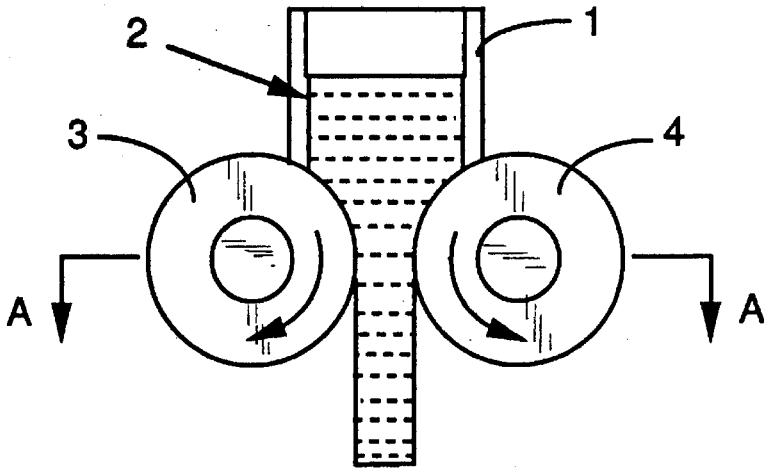
PRIOR ART FIG. 3
FIG. 3 is an elevational view of a prior art twin casing mold.
Figure 4:
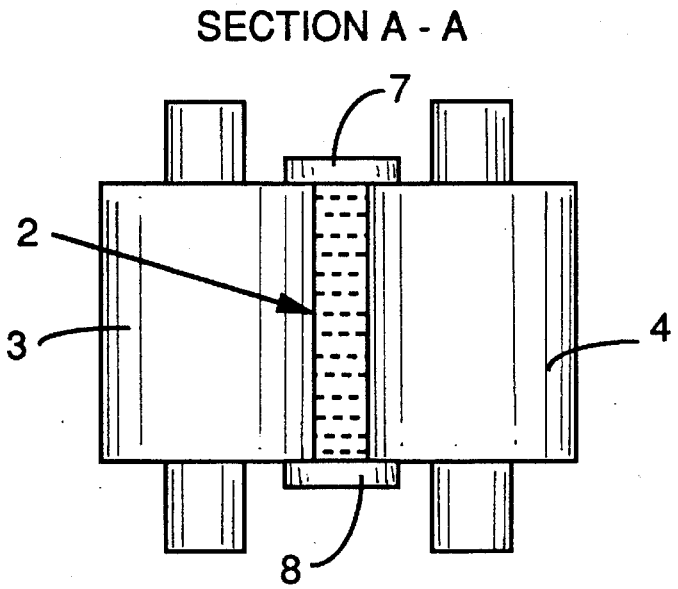
PRIOR ART FIG. 4
FIG. 4 is a plan view taken along line A—A of FIG. 3.

The present invention is applied to a twin roller strip caster of the general type shown in FIGS. 3 and 4 in which liquid metal 2, contained in a tundish 1, is fed between two rotating cylindrical rolls 3 and 4. The rolls may be cooled by any suitable means. At the roll edges, the liquid metal is contained by keeper plates 7 and 8. A surface layer of the cast metal is solifified at the exit of the rolls 3, 4.

As noted, the roll peripheral surfaces are generally flat, that is the rolls are of plain cylindrical form. Such a prior art caster has the same problem in respect to formation of longitudinal cracks as a caster having a stationary strip casting mold with rectangular cross-section.

Such problem is solved by application of the present invention wherein at least a portion of the roll surface is a convex or concave surface.

Figure 5:
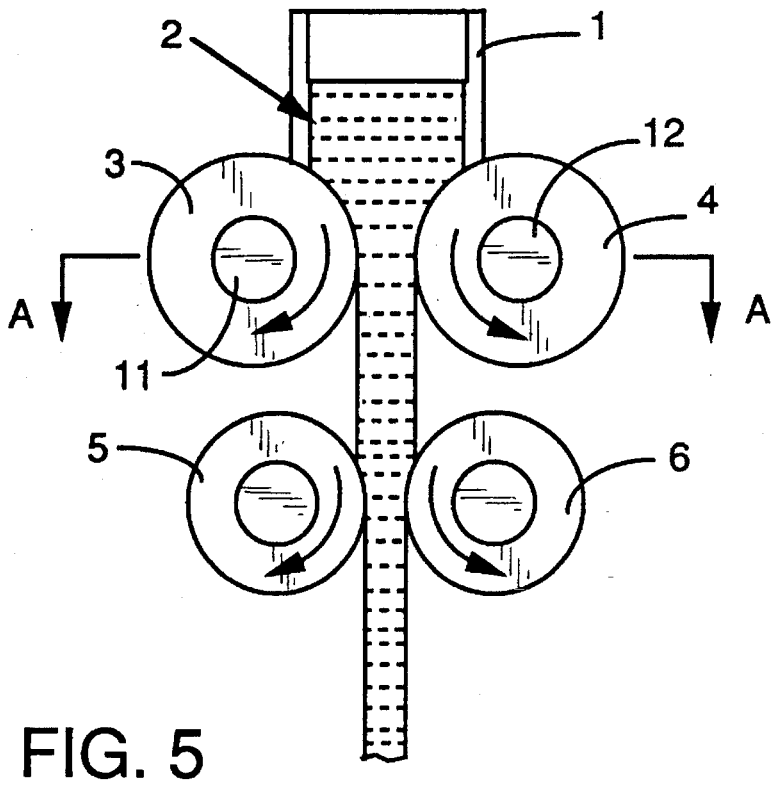
FIG. 5 is an elevational view of a first embodiment of the present invention, in which the rolls have a convex surface.
Figure 6:
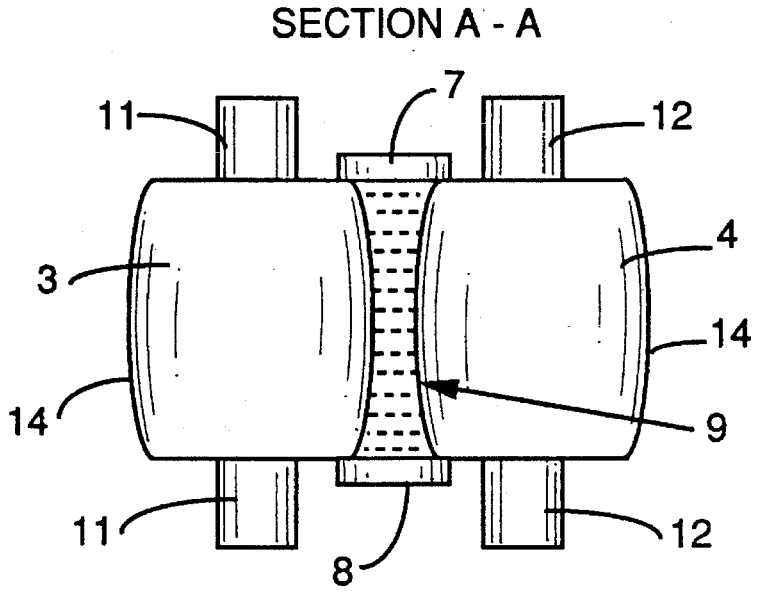
FIG. 6 is a plan view taken along line A—A of FIG. 5.

For example, FIGS. 5 and 6 show a twin roll caster in accordance with a first embodiment of the invention in which rolls 3, 4 have a convex surface 14, providing a casting of concave form. Roll 3 has necks 11 and roll 4 has necks 12. Planishing rolls 5, 6 are added to provide some squeezing of the cast strip to assure a rectangular cross-section of the cast strip after solidification.

Figure 7:
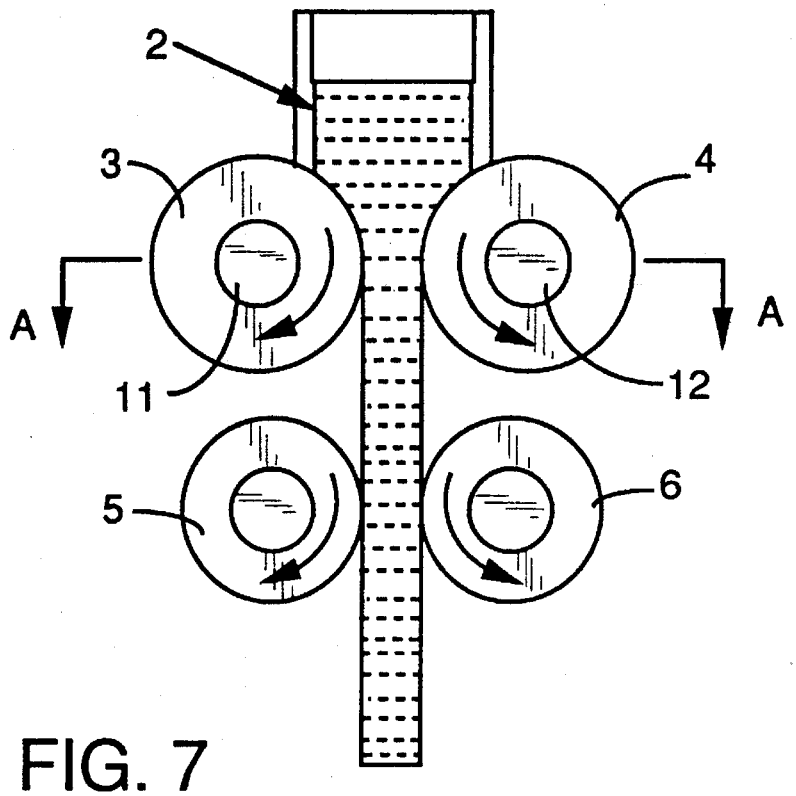
FIG. 7 is an elevational view of a second embodiment of the present invention, in which the rolls have a concave surface.
Figure 8:
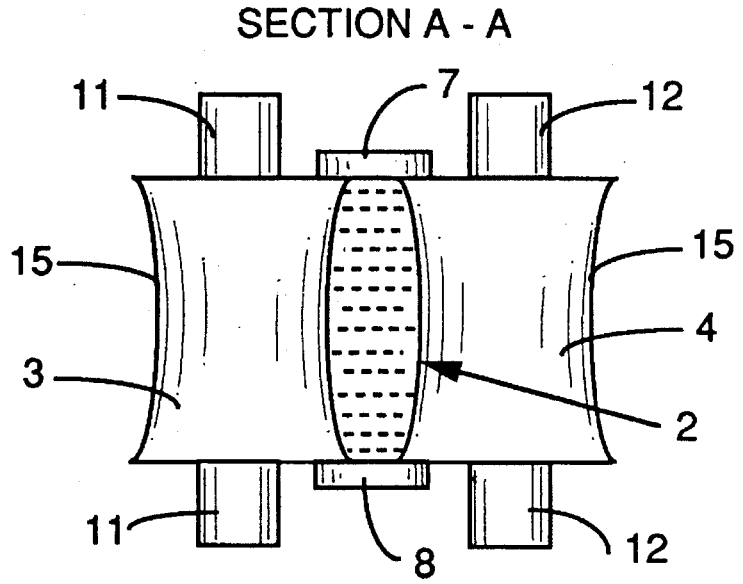
FIG. 8 is a plan view taken along line A—A of FIG. 7.

In FIGS. 7 and 8 there is illustrated a second embodiment of the invention in which rolls 3 and 4 have a concave surface 15, providing a casting of convex form. As in the case of the first embodiment, planishing roll 5 and 6 are provided to assure a rectangular cross-section of the cast strip after solidification.

Figure 9:
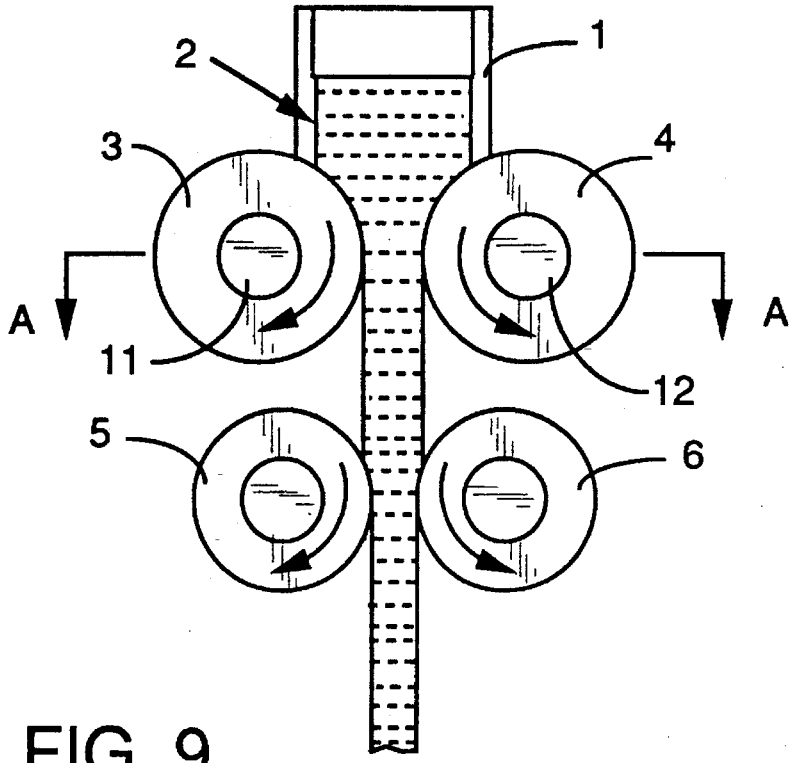
FIG. 9 is an elevational view of a third embodiment of the present invention, in which the rolls have a partial convex surface.
Figure 10:
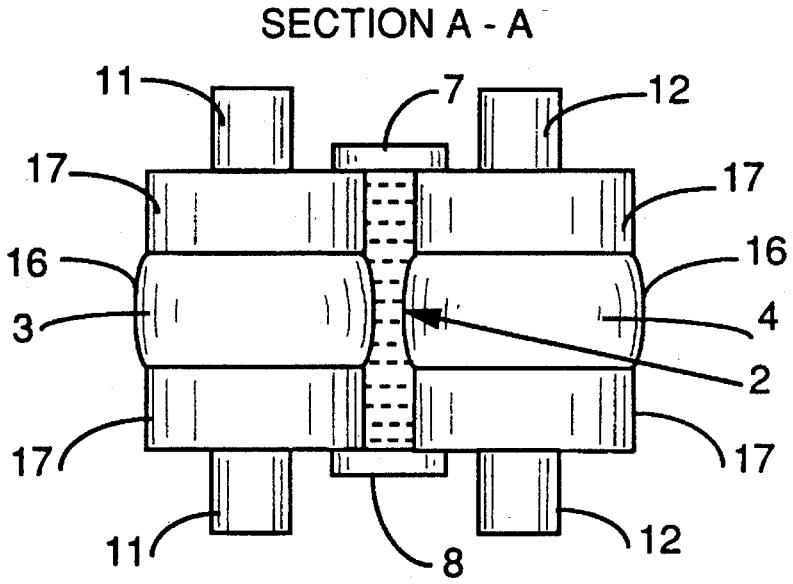
FIG. 10 is a plan view taken along line A—A of FIG. 9.

FIGS. 9 and 10 show a third embodiment of the invention in which rolls 3 and 4 have a partial convex surface 16, in the middle of the nip between the rolls, the edges 17 being of cylindrical form giving a planar surface to the adjacent cast strip. Here, too, planishing rolls 5 and 6 are provided to assure a rectangular strip cross-section on solidification.

Figure 11:
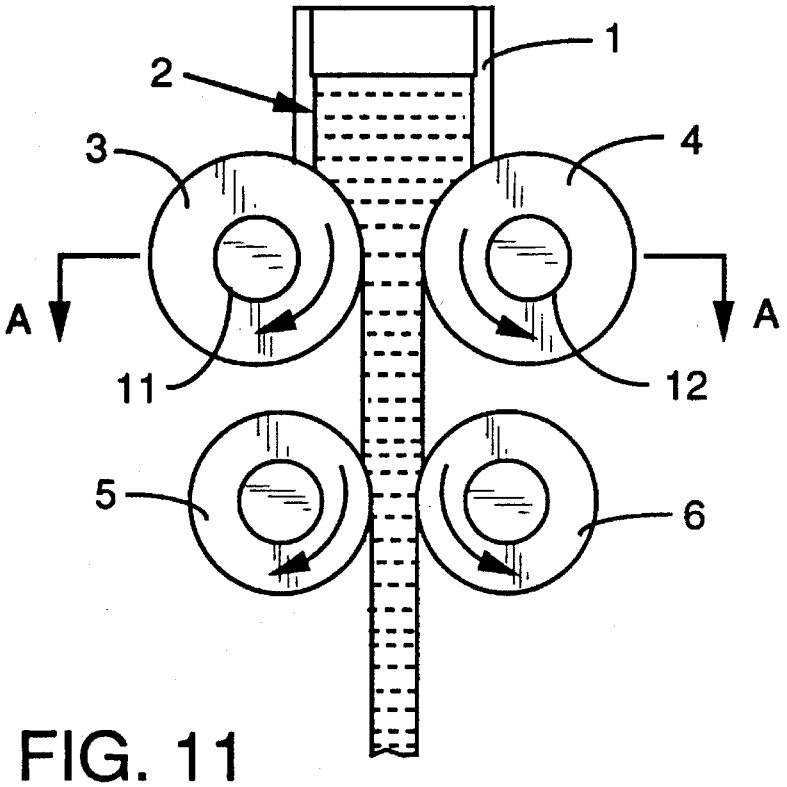
FIG. 11 is an elevational view of a fourth embodiment of the present invention, in which the rolls have a partial concave surface.
Figure 12:
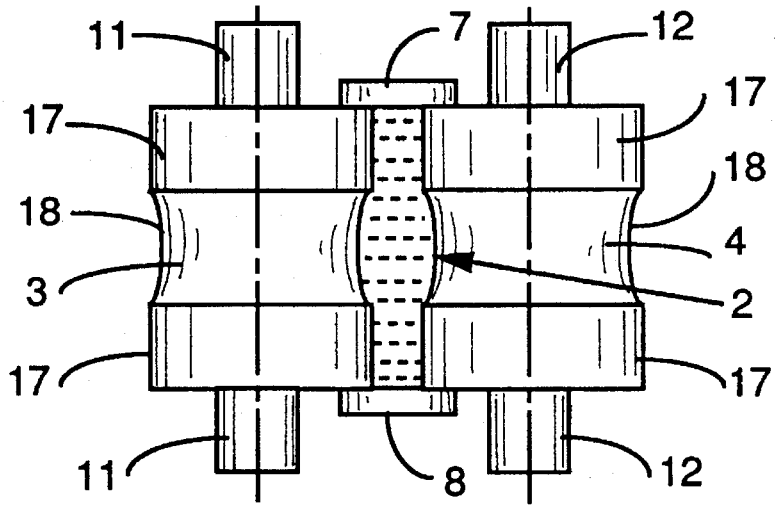
FIG. 12 is a plan view taken along line A—A of FIG. 11.

In a fourth embodiment illustrated in FIGS. 11 and 12, the rolls 3 and 4 have a concave surface 18 in the middle of the nip and planar surfaces 17 produced by cylindrical surfaces at the edges of the rolls. Here also planishing rolls 5 and 6 are provided to produce a squeezing effect to assure a rectangular strip cross-section on solification of the strip.

Figure 13:
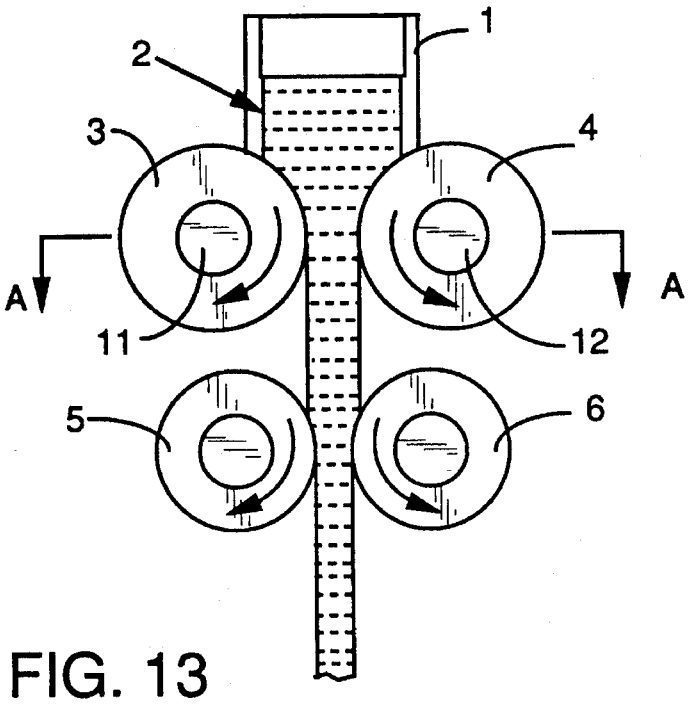
FIG. 13 is an elevational view of a fifth embodiment of the present invention, in which the rolls are subjected to bending forces to provide a convex or concave roll surface at the casting nip.
Figure 14:
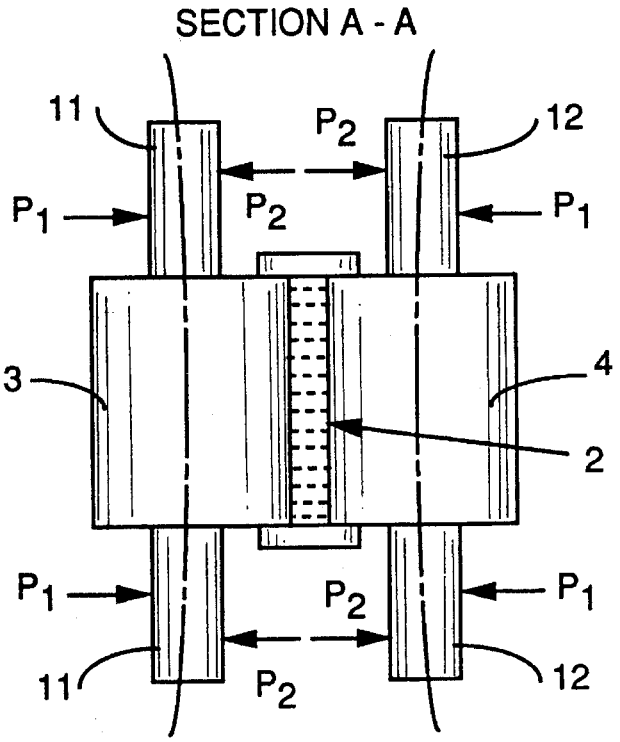
FIG. 14 is a plan view taken along line A—A of FIG. 13.

In a fifth embodiment of the invention, illustrated in FIGS. 13 and 14, rolls 3 and 4 have cylindrical surfaces but means (not shown) are provided to exert roll bending forces $P_1$ and $P_2$ to the necks 11, 12 of the rolls 3 and 4 to produce either a convex or a concave strip profile. In FIG. 14, the forces $P_1$ and $P_2$ are such as to produce a convex roll profile, but it is to be understood that these forces may be so directed to produce a concave roll profile.

Figure 15:
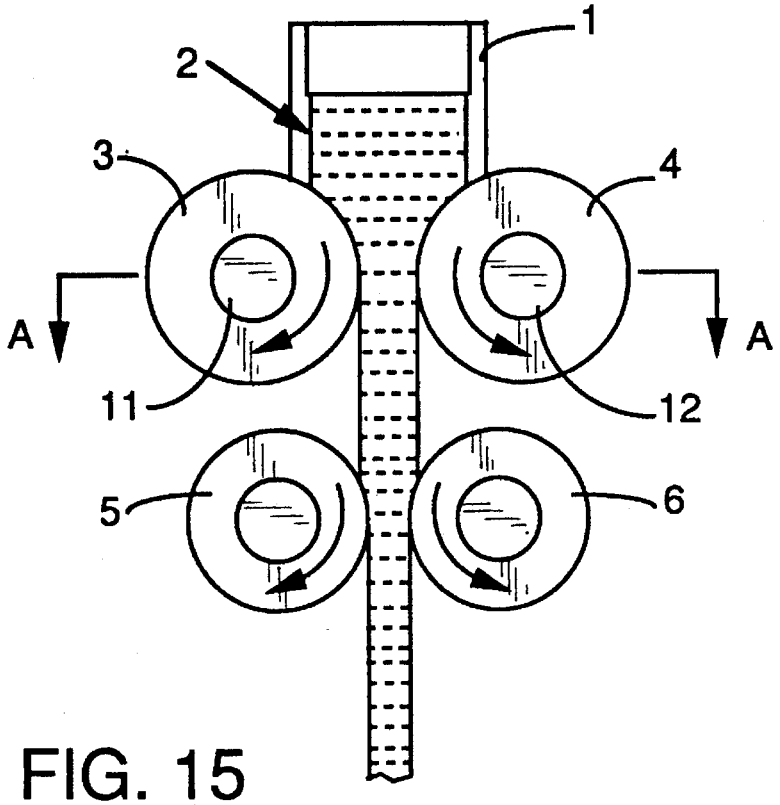
FIG. 15 is an elevational view of a sixth embodiment of the present invention, in which cooling sprays are used to provide a thermal crown in the rolls.
Figure 16:
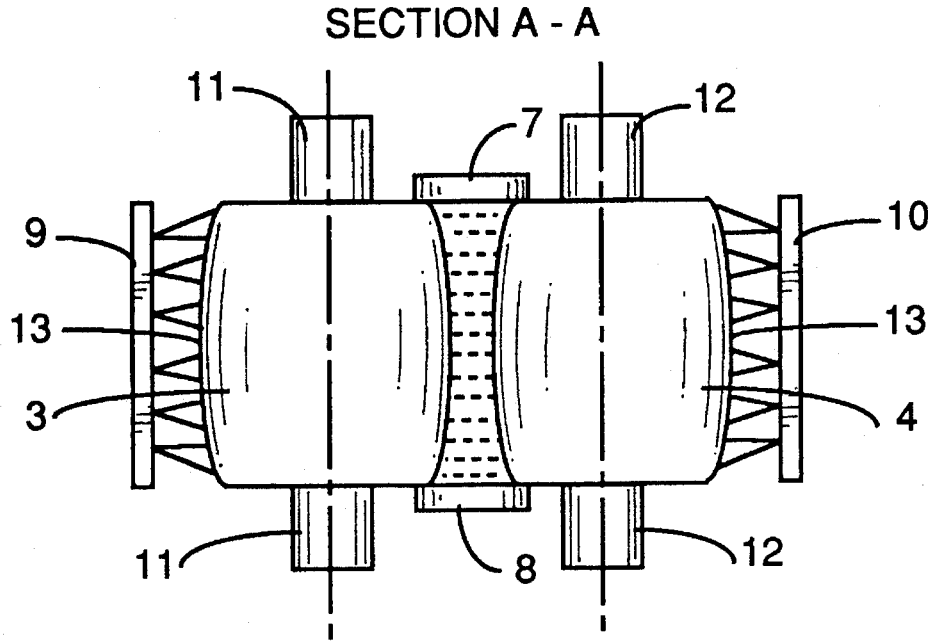
FIG. 16 is a plan view taken along line A—A of FIG. 15.

In FIG. 15 and 16, there are provided cooling fluid headers 9 and 10, e.g. for cooling water or air-mist cooling fluid, which provide a desirable pattern of heat removal from the rolls 3 and 4 along the length thereof to produce a desirable thermal crown 13 of the rolls. Similar effects can be achieved with internal cooling of the rolls 3 and 4.

What is claimed is:

1. In a twin roll strip caster of the type having a pair of opposed, oppositely rotatable, cooled necked cylindrical rolls defining a casting-forming nip therebetween, means to feed a liquid metal into a nip between the rolls, and rolling means to roll the cast strip, the improvement comprising means to apply roll bending forces to the necks of the rolls and to bend the rolls into a convex or concave shape with respect to the nip.

2. A method of inhibiting edge cracking of a metal strip during casting the strip in a twin roller caster having a pair of oppositely rotating rolls defining a nip therebetween for reception of liquid metal to be cast, comprising forming each of the rolls with a surface of convex or concave configuration in a middle portion and of cylindrical configuration in edge portions of the nip between the rolls, introducing liquid metal into the nip, and casting a strip having, respectively, concave or convex wide cast strip surfaces in a middle portion of the strip and flat edge portions.

3. A method of casting a metal strip in a twin roller caster having a pair of oppositely rotating necked rolls defining a nip therebetween for reception of liquid metal to be cast, comprising applying bending forces to the necks of the rolls to bend the rolls into a convex or concave shape with respect to the nip, pouring liquid metal between the rolls, and rotating the rolls to form a cast strip having a contour of convex or concave shape.

* * * * *